US005361058A

United States Patent [19]

Mosesian et al.

[11] Patent Number: 5,361,058

[45] Date of Patent: Nov. 1, 1994

[54] TIME DELAY FUSE

[75] Inventors: Jerry L. Mosesian, Newburyport, Mass.; Clyde D. Reid, South Hampton, N.H.

[73] Assignee: Gould Electronics Inc., Eastlake, Ohio

[21] Appl. No.: 146,319

[22] Filed: Nov. 2, 1993

[51] Int. Cl.[5] ..... H01H 85/04

[52] U.S. Cl. ..... 337/163; 337/161

[58] Field of Search ..... 337/158, 159, 160, 161, 337/162, 163, 164, 165, 166

[56] References Cited

U.S. PATENT DOCUMENTS

| | | | |
|---|---|---|---|
| 876,273 | 1/1908 | Hall . | |
| 2,639,350 | 5/1953 | Cox . | |
| 2,873,327 | 2/1959 | Bernstein . | |
| 3,301,979 | 1/1967 | Fister . | |
| 3,425,019 | 1/1969 | Kozacka | 337/163 |
| 3,701,069 | 10/1972 | Belcher . | |
| 3,868,619 | 2/1975 | Blewitt . | |
| 4,297,666 | 10/1981 | Asdollahi . | |
| 4,386,334 | 5/1983 | Kozacka et al. . | |
| 4,414,528 | 11/1983 | Bernstein . | |
| 4,528,536 | 7/1985 | Blewitt et al. . | |
| 4,540,970 | 9/1985 | Kasamatsu . | |
| 4,689,596 | 8/1987 | Huber | 337/162 |
| 4,703,300 | 10/1987 | Gala | 337/163 |
| 4,749,980 | 6/1988 | Morrill, Jr. et al. . | |
| 4,860,437 | 8/1989 | Morrill, Jr. et al. . | |
| 4,920,327 | 4/1990 | Arikawa et al. . | |
| 5,130,688 | 7/1992 | Van Rietschoten et al. . | |
| 5,142,262 | 8/1992 | Onken . | |

FOREIGN PATENT DOCUMENTS

| | | |
|---|---|---|
| 948894 | 10/1953 | Germany . |

*Primary Examiner*—Lincoln Donovan
*Attorney, Agent, or Firm*—Fish & Richardson

[57] ABSTRACT

A time delay fuse including a fuse casing, terminals located on the exterior of the casing, a hollow electrically insulated inner core having first and second holes in the walls thereof, a fusible element that makes electrical connection to the terminals and is disposed on the surface of the core such that the length of the element is greater than the distance between the terminals, the element passing through the holes, and a material that is deposited on a portion of the element passing through the interior of the core and lowers the melting temperature of that portion.

13 Claims, 1 Drawing Sheet

TIME DELAY FUSE

BACKGROUND OF THE INVENTION

The invention relates to time delay fuses.

Time delay fuses are used in connection with equipment having temporary current surges, such as motors and transformers. Time delay fuses often employ a fusible element and a spring-loaded heat mass. A deposit of solder retains the heat mass from movement by the spring. The dimensions of the fusible element are selected such that it melts quickly under short-circuit conditions (e.g., 30 times the rated current of the fuse). However, when lower overload conditions (e.g., 2 to 4 times rated current) persist for a predetermined amount of time, the solder instead melts, releasing the heat-mass to break the circuit.

Another approach used in time delay fuses utilizes the "M-effect," which is achieved by depositing a tin-bearing metal on the surface of a copper, silver, brass, or phosphor-bronze element such that the two metals alloy. The resulting alloy has a lower melting point than the element material alone. At low-overload conditions, the fusible element slowly generates heat. Eventually, the temperature rise is sufficient to melt the alloy region at the solder/tin deposit and thereby break the circuit. The time needed to generate the necessary heat results in a delay.

SUMMARY OF THE INVENTION our invention features, in general, a time delay fuse the interior of which contains a hollow insulated core. A fusible element is connected at each end to a fuse terminal and is disposed on the surface of the core such that the total length of the fusible element exceeds the distance between the two terminals. A portion of the fusible element is within the core, and a material deposited on this portion lowers the melting temperature at this portion of the element, providing delayed melting at this portion of the fusible element and breaking of the circuit at low overloads.

This time delay fuse design eliminates the need for a heat-mass and spring assembly, reducing both manufacturing cost and packaging size. Additionally, a fuse according to the present invention can have both a low nominal current rating, and a high transient in-rush current rating (i.e., it can withstand short periods of very high overload conditions). The in-rush current rating of a fuse is determined by the cross-sectional area of the fusible element. However, increasing cross-sectional area to increase the in-rush current rating decreases the resistance per unit length of the fusible element, requiring that a longer length be used to obtain the resistance needed for the nominal current rating. Because the fusible element in the present invention is longer than the distance between the two terminals, it is possible to include in a small package a long fusible element with a large cross-sectional area to increase the in-rush rating while maintaining the desired nominal rating. In one exemplary embodiment, this is accomplished by spiral-winding the fusible element around the surface of the core.

In preferred embodiments, the portion of the fusible element carrying the melting temperature lowering material extends between two holes in the core. The fuse casing is cylindrical and has an inner diameter that is less than the sum of the exterior diameter of the core and eight times (most preferably three times) the thickness of the fusible element. This provides a relatively small volume for the interrupt arc and metal vapor resulting when a high overload current is applied. The high pressures thus developed are sufficient to quench the arc, thus both stopping all current flow through the fuse and preventing the fuse from exploding.

Other advantages and features of the invention will be apparent from the following description of a preferred embodiment thereof and from the claims.

DESCRIPTION OF THE PREFERRED EMBODIMENT

Figure 1:
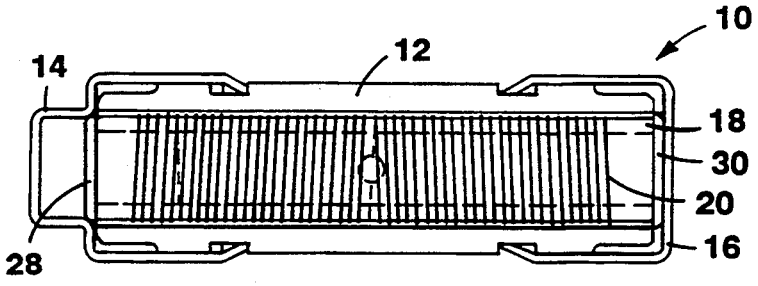
FIG. 1 is a vertical sectional view of a time delay fuse according to the invention.

Referring to FIG. 1, there is shown time delay fuse 10, which includes tubular fuse casing 12 (made of glass melamine glass), on which are crimped end ferrules 14 and 16. The length of fuse casing 12 is 1.290", and the outer and inner diameters are 0.352"+0.005" and 0.250"+0.005"−0.000", respectively. Within casing 12 is a hollow inner core 18 (also made of glass melamine glass), around which is spiral-wound fusible element 20 made from wire (phosphor-bronze alloy C524000). The length of inner core 18 is 1.275", and the outer and inner diameters are 0.227"+0.000"−0.005", and 0.187"+0.005", respectively.

The size of fusible element 20 determines the ampere rating and time delay characteristics of fuse 10. For example, in a fuse with a current rating of 3/16 amperes, fusible element 20 has a diameter of 0.0030" and is 32" to 38" long; this fuse will tolerate a 10 millisecond current pulse of up to 75/16 amperes (25×3/16). In a fuse with a current rating of 1.8 amperes, fusible element 20 has a diameter of 0.0075" and is 2.0" long; the fuse will tolerate a 10 millisecond current pulse of up to 45 amperes (25×1.8). The ends of fusible element 20 electrically contact end ferrules 14 and 16.

Figure 2:
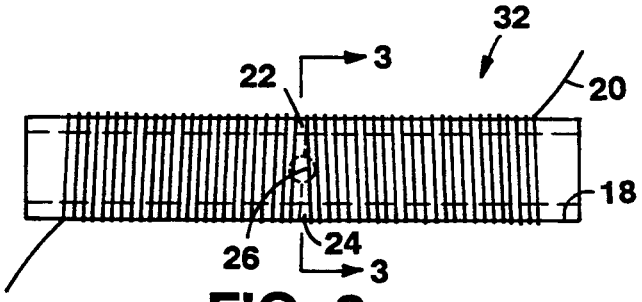
FIG. 2 is a plan view of a subassembly of the FIG. 1 fuse.
Figure 3:
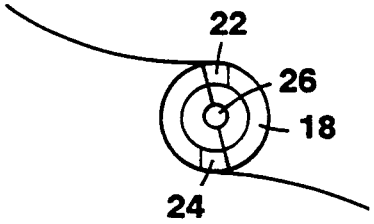
FIG. 3 is a vertical sectional view, taken at 3—3 of FIG. 2, showing the orientation of the fusible element of the FIG. 2 subassembly.

Referring to FIGS. 2 and 3, fusible element 20 passes through holes 22 and 24 in the wall of inner core 18. Holes 22 and 24 are located at the axial midpoint of inner core 18, and are offset 180° from one another. Tin bead 26 is deposited at the midpoint of that portion of fusible element 20 that passes through the interior of inner core 18.

In manufacture, tin bead 26 is first deposited on fusible element 20, which is then passed through holes 22 and 24 until tin bead 26 is centered with respect to inner core 18. Exact positioning of tin bead 26 is not critical, but the bead must not be allowed to contact the inner surface of core 18. Fusible element 20 is then spiral-wound around the outer surface of inner core 18 to result in assembly 32 (see FIGS. 2 and 3), the total number of coils being determined by the length of fusible element 20. For a 3/16 amp fuse of 0.003" wire, element 20 is approximately 32" to 38". Adjacent coils must not touch, and should be equally spaced along the length of inner core 18.

After spiral-wrapping fusible element 20, the two free ends of element 20 are trimmed and tucked over the ends of inner core 18 and into the core's hollow interior.

Eyelets 28 and 30 (see FIG. 1) are then inserted into the ends of inner core 18 to secure and provide electrical contact with the ends of fusible element 20. The resulting inner core subassembly is then inserted into fuse casing 12, and end ferrules 14 and 16 are installed, with solder (not shown) located between ferrules 14 and 16 and eyelets 28 and 30. Ferrules 14 and 16 are then crimped to the fuse casing 12, and the ends are subjected to induction-heating to melt the solder, electrically connecting each ferrule 14 and 16 to its associated eyelet 28 and 30.

In operation, when the current passing through fuse 10 remains at twenty-five times the rated nominal current of the fuse for longer than 10 milliseconds, fusible element 20 ionizes and forms an interrupt arc. At higher currents, element 20 ionizes sooner. Because fusible element 20 is largely confined in the relatively small volume defined by the region between the inner surface of fuse casing 12 and the outer surface of the inner core 18, high pressures develop in this inter-tubular region during ionization. These pressures quench the interrupt arc, thus both stopping all current flow through the fuse and preventing the fuse from exploding.

At low overload currents, for example two times the rated current, fusible element 20 is such that it will not ionize. Rather, the portions of element 18 supported by core 18 will conduct heat to core 18, and the portion in the interior of core 18 will rise in temperature and have the hottest temperature. When the tin bead region of fusible element 20 reaches its melting temperature, the region fuses, breaking electrical contact between end ferrules 14 and 16.

Other embodiments of the invention are within the scope of the following claims.

What is claimed is:

1. A time delay fuse comprising: an elongated fuse casing defining an interior chamber and having a longitudinal axis, first and second terminals located along said axis on the exterior of said casing at opposite ends of said casing, a hollow, elongated, electrically non-conductive core located within said interior chamber, said core extending along said longitudinal axis and having approximately the same shape as said interior chamber, said core having an inner region therein, said fuse having an outer region around said core and inside of said fuse casing all of the way around said core, a fusible element making electrical connection at one end to said first terminal and electrical connection at the other end to said second terminal, said fusible element being disposed on the surface of said insulated core in said outer region such that the length of said element is greater than the distance between said first and second terminals, said fusible element having a portion disposed within said inner region within said hollow core, and a material deposited on said portion of said fusible element within said inner region within said core for lowering the melting temperature of that portion, said material not contacting and being spaced from said non-conductive core.

2. The time delay fuse of claim 1 wherein said fusible element is spiral-wound on the surface of said core.

3. The time delay fuse of claim 1 wherein said fusible element is a wire.

4. The time delay fuse of claim 3 wherein said wire is a phosphor-bronze wire.

5. The time delay fuse of claim 1 wherein said material is tin.

6. The time delay fuse of claim 1 wherein said hollow core has first and second holes at respective first and second locations in the wall of said core, and said portion of said fusible element within said core extends between said first and second holes.

7. The time delay fuse of claim 6 wherein said first, and said second locations are generally at the axial midpoint of said core.

8. The time delay fuse of claim 1 wherein said core is a cylindrical body, and said interior chamber is cylindrical.

9. The time delay fuse of claim 8 wherein the diameter of said interior chamber is less than eight times the thickness of said fusible element plus the exterior diameter of said core.

10. The time delay fuse of claim 9 wherein the diameter of said interior chamber is less than eight times the thickness of said fusible element plus the exterior diameter of said core.

11. The time delay fuse of claim 1, further including an arc-quenching material surrounding a portion of said element that is disposed on said core.

12. The time delay fuse of claim 11 wherein said arc-quenching material is quartz crystal.

13. The time delay fuse of claim 1 wherein said first and second terminals are end cap terminals.

* * * * *

UNITED STATES PATENT AND TRADEMARK OFFICE

CERTIFICATE OF CORRECTION

PATENT NO. : 5,361,058

DATED : November 1, 1994

INVENTOR(S) : Jerry L. Mosesian

It is certified that error appears in the above-identified patent and that said Letters Patent is hereby corrected as shown below:

Col. 1, line 31, capitalize "o" in --our--.

Col. 2, line 27, insert a "-" under the "+" sign.

Col. 2, line 34, insert a "-" under the "+" sign.

Col. 3, line 36, indent and make a new paragraph beginning with "an elongated fuse".

Signed and Sealed this

Thirtieth Day of July, 1996

Bruce Lehman

*Attest:*

BRUCE LEHMAN

*Attesting Officer*

*Commissioner of Patents and Trademarks*